United States Patent [19]

De Filippis et al.

[11] 4,352,963

[45] Oct. 5, 1982

[54] LOW PROFILE MICROSWITCHES, PARTICULARLY USEFUL FOR THE COMPOSITION OF KEYBOARDS AND METHOD OF MAKING

[75] Inventors: Pietro De Filippis; Amedeo Salvatore; Luigi Abbondandolo, all of Naples, Italy

[73] Assignee: Texas Instruments Incorporated, Dallas, Tex.

[21] Appl. No.: 175,230

[22] Filed: Aug. 5, 1980

[51] Int. Cl.[3] ..... H01H 13/70

[52] U.S. Cl. ..... 200/5 A; 200/159 B; 200/275

[58] Field of Search ..... 200/1 R, 5 R, 5 A, 86 R, 200/159 B, 275, 292

[56] References Cited

U.S. PATENT DOCUMENTS

| | | | |
|---|---|---|---|
| 3,967,084 | 6/1976 | Pounds . | |
| 3,995,128 | 11/1976 | Hawkins | 200/5 A |
| 4,046,981 | 9/1977 | Johnson et al. | 200/159 B |
| 4,074,088 | 2/1978 | Keough et al. | 200/5 A |
| 4,254,309 | 3/1981 | Johnson | 200/5 A |

*Primary Examiner*—James R. Scott

*Attorney, Agent, or Firm*—John A. Haug; James P. McAndrews; Melvin Sharp

[57] ABSTRACT

A keyboard unit is shown having a substrate in which portions of the substrate are physically displaced to provide a cavity, an embossment and a plurality of protuberances for each switching station. The embossment, in registry with a button contact area, projects upwardly from the floor of the cavity a selected distance with a discontinuance annulus contact area extending around its respective cavity in generally the same plane as that in which the top surface of the substrate lies. The cavity includes a channel shaped portion extending through the discontinued portion of the discontinuous annulus. The protuberances project upwardly from the general plane of the substrate's top surface and serve to laterally locate a snap-acting disc over the contact areas. The disc may be selectively coated with highly electrically conductive material to optimize electrical switching. A piece of flexible, electrically insulative sheet may be placed over the unit to seal it from the environment.

7 Claims, 8 Drawing Figures

LOW PROFILE MICROSWITCHES, PARTICULARLY USEFUL FOR THE COMPOSITION OF KEYBOARDS AND METHOD OF MAKING

BACKGROUND OF THE INVENTION

The invention relates to an improvement in low profile microswitches particularly useful for the composition of keyboards.

More in particular the present invention relates to a microswitch of the above-said kind which may be realized with low cost on a printed circuit with high reliability.

Low profile microswitches are known, which use a spherical cap member as a movable switching element normally having the convexity directed outwardly. When a pressure is exerted on the spherical cap it inverts its curvature with a snap action and electrically closes contacts located on an insulating panel.

However, this known construction of low profile switches results in production costs which are relatively high as well as having a relatively larger number of components to be assembled.

An object of this invention is to provide an improved structure for low profile microswitches, utilizing as a main switching member an element shaped as a spherical cap. Another object of the invention is the provision of a low cost, highly reliable keyboard having fewer parts to assemble than many prior art keyboards. Other objects and features of this invention will be in part apparent and in part pointed out hereinafter.

SUMMARY OF THE INVENTION

Briefly, according to the invention, a low profile keyboard unit comprising an electrically insulating substrate, such as a phenolic bonded fibre substrate, is formed with conventional printed circuit areas including one or more switching stations, each station comprising a discontinuous, generally annular contact area and an inner button contact area centrally disposed therein. For each station, portions of the substrate are displaced, as by means of a half punching operation to provide a cavity, an embossment and a plurality of protuberances. The embossment projects upwardly from the bottom of the cavity and is in registry with the inner button contact area. The inner portion of the annular contact area is also disposed within the cavity while the protuberances extend above the general plane of the substrate and are disposed around the annular contact area in such a manner so as to laterally locate a snap-acting disc over the contact areas. The cavity also includes a channel shaped portion extending through the discontinued portion of the discontinuous annulus. The snap-acting discs may be plated with highly electrically conductive metal in selected areas adapted to come into physical engagement with the contact areas of the substrate. A sheet of adhesive coated flexible material may be placed over the substrate and discs protect the unit from the environment.

BRIEF DESCRIPTION OF THE DRAWING

The present invention will be now disclosed with reference to a presently preferred embodiment referred to as an illustration, without limitations, and on the basis of the attached drawings, wherein.

Corresponding reference characters indicate corresponding parts throughout the several views of the drawings.

DESCRIPTION OF THE PREFERRED EMBODIMENTS

Let us refer now to the drawings and in particular to FIGS. 1 to 4.

Figure 1:
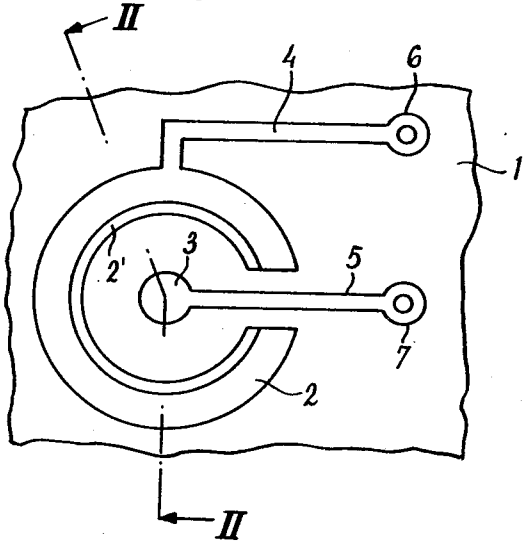
FIG. 1 shows a top plan view of a portion of printed circuit whereon the static or fixed contacts of the microswitch according to the present invention are realized.

On an insulating panel of the kind used for printed circuits, for instance, comprising a substrate 1 of fibers bonded with a phenolic resin and provided with the usual electrically conductive layer, there is obtained by conventional photoetching operations a pattern of the kind shown in said FIG. 1, comprising a first conductive area 2 having a discontinuous, substantially annular configuration and a "button" 3 located at the center of the annulus. The conductive areas 2, 3 are brought to respective conventional soldering pads 6, 7 with respective traces 4, 5.

Figure 2:
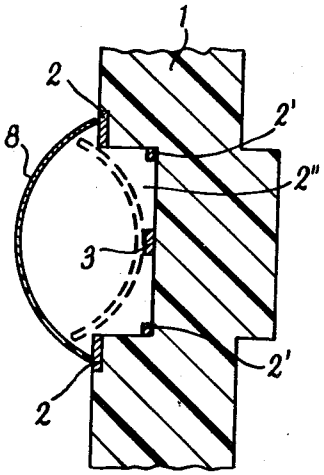
FIG. 2 shows, with exaggerated "thickness" proportions, a section along line II—II of FIG. 1.

As one can see from FIG. 2, the part comprising and internal to the conducting area 2' is by means of a partial punching operation, displaced or "lowered" with respect to the general plane of the surface of the substrate 1 forming a cavity 2'', in which the "button" 3 is disposed on a plane different from the one of the coductive area 2.

In registry with the conductive area 2 there is located an electrically conductive, disc shaped spherical cap member 8, shown in full line position in FIG. 2 with the convex surface directed outwardly when the same is in the rest condition, and with dotted lines with the convex surface directed inwardly when it is in the actuated condition.

It will be seen that in the actuated condition the peripheral and central areas of the disc 8 electrically close a contact between the internal border of the conducting area 2 and the button 3. As noted above, the displaced portion of the substrate forming cavity 2'' includes a small conducting portion 2' so that the peripheral edge defining of the cavity is defined by conductive area 2 to ensure good electrical contact in the actuated configuration of the disc. Additionally disc 8 is provided with highly electrically conductive metal plating on selected portions 8', 8'' for guaranteeing good electrical contact.

One will see that the dimensions of the curvature of disc 8 and the depth of cavity 2'' are greatly exaggerated with respect to the actual dimensions as it will be clear to a person skilled in the art.

Figure 3:
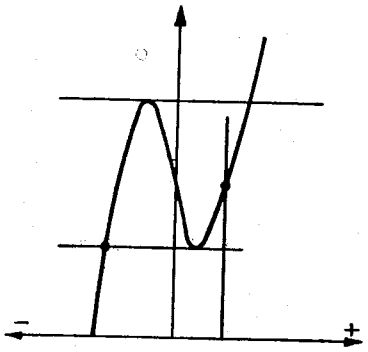
FIG. 3 shows the behavior of forces and displacements relating to the contact member having the shape of a spherical cap.
Figure 4:
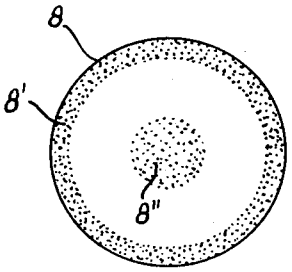
FIG. 4 shows a bottom plan view of the spherical cap element (the side of the element which makes electrical engagement with the fixed contact)

FIG. 3 shows the force/displacement relationship in the deformation action of the disc 8 for closing electric contact providing the aforesaid snap action.

What is shown in FIGS. 1–4 is exemplary to show the operation concept of the microswitch according to this invention.

Now let us refer to FIGS. 5–8.

On the insulating substrate 10, there is realized with conventional techniques used for printed circuits both the areas 11, 12 and the area 13, with respective connection traces 14, 15.

Figure 6:
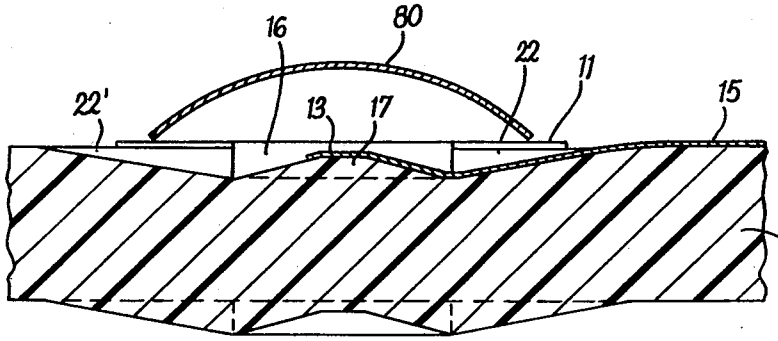
FIG. 6 shows a sectional view along line VI—VI of FIG. 5.
Figure 5:
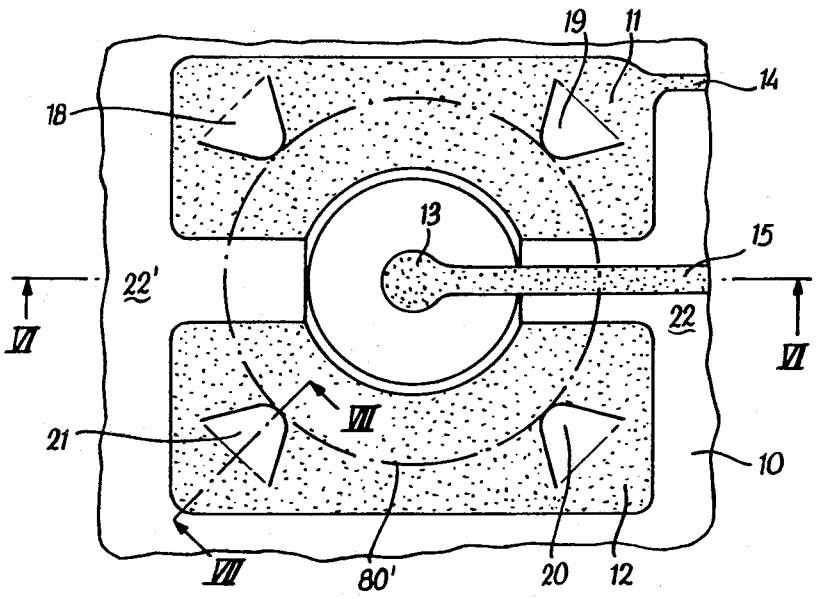
FIG. 5 shows a top plan view of a microswitch according to the present invention in greater detail.
Figure 8:
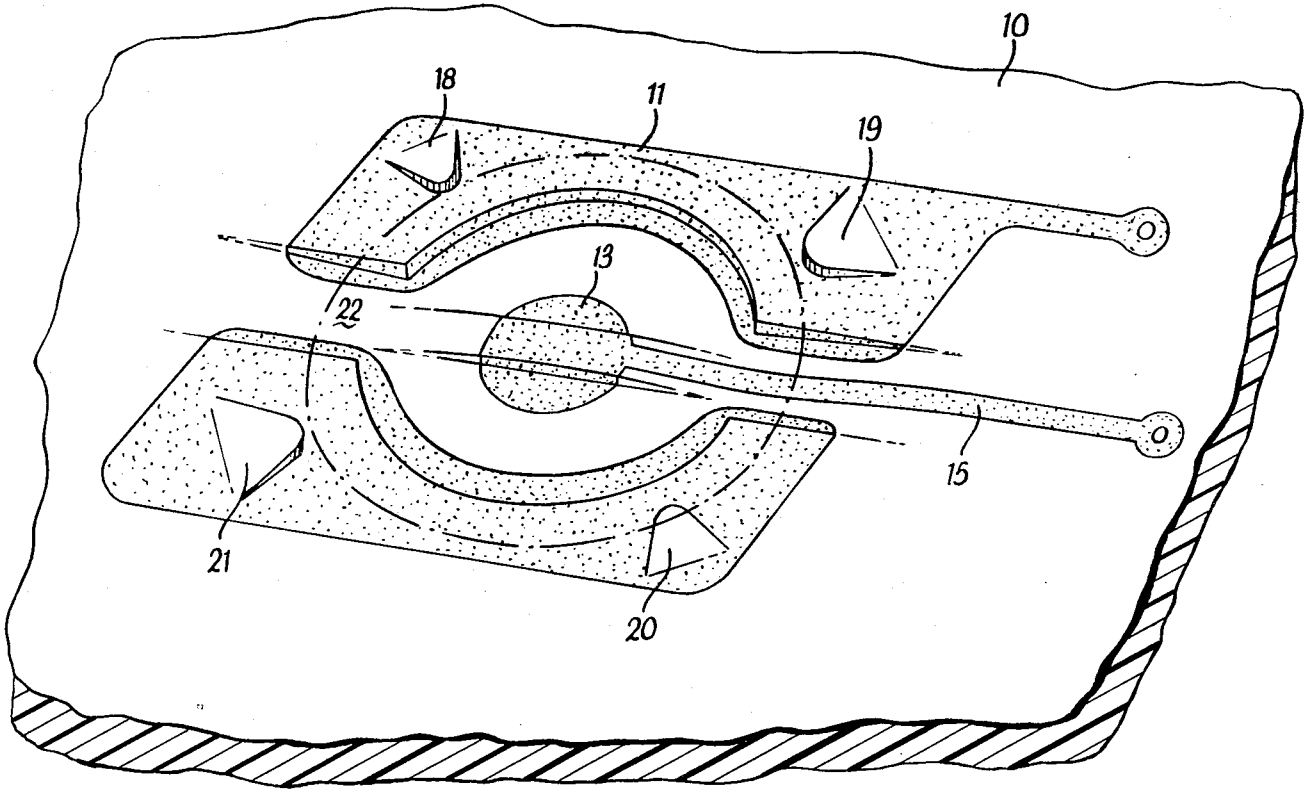
FIG. 8 shows a perspective view of the shaped printed circuit board carrying the fixed contacts of the microswitch according to the present invention.

From a combined consideration of FIGS. 5, 6, 8, it can be seen how by means of a half-punching operation, there is obtained a shifting of the planes of the substrate for obtaining cavity 16 (corresponding to cavity 2″ of FIG. 2) and an embossment 17 in registry with the contact area 13 with the opposite surface configuration formed in the bottom surface of substrate 10.

The contact disc 80 occupies in FIG. 5 the position defined by the circle 80′.

Figure 7:
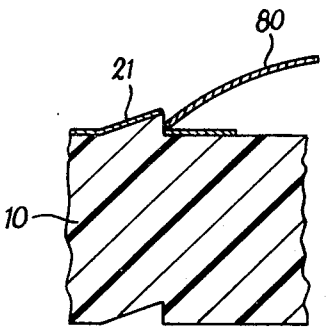
FIG. 7 shows a partial sectional view on line VII—VII of FIG. 5.

Disc 80 is maintained centered on the circle 80′ by means of a plurality of half-punched protuberances 18, 19, 20, 21 (see in particular the detail of FIG. 7).

While four half-punched protuberances are shown their number and shaping is a matter of choice. These protuberances are needed for the lateral centering of disc 80 in the correct position.

It should be noted that the half-punching that forms cavity 16 and protuberance 17 forms also a channel 22, 22′ useful both for allowing the air enclosed by disc 80 to escape, as well as for allowing passage of other traces of interconnections of the printed circuit which are not directly related to the switch of the invention.

The unit may be covered with a sheet of adhesive coated, electrically insulative flexible material, for example, "Mylar" for the protection of the switch against the environment.

It should be noted also that protuberance 17 may be formed by the mechanical operation so that it protudes beyond the upper plane of the substrate 15, if desired, for utilizing a movable contact member shaped as a "top hat". That is, a contact member provided with some type of feet or rim to raise the deformable portion of the disc above the plane of the contact member support.

Naturally, on a single substrate 10 a plurality of microswitches of the above-said kind may be realized for constituting keyboards with the desired number of switching points.

With the structure according to the present invention there are obtained among others, the following advantages:

(a) elimination of the usual disc retaining member;
(b) elimination of the staples of conventional keyboards of this kind;
(c) greater reliability owing to the fact that fewer parts are employed as well as the elimination of the wave soldering operations of the staples; and
(d) the possibility of using a panel with a single metallized layer thereby resulting in lower costs.

In view of the above, it will be seen that the several objects of the invention are accrued and other advantageous results attained.

As various changes could be made in the above constructions without departing from the scope of the invention, it is intended that all matter contained in the above description or shown in the accompanying drawings shall be interpreted as illustrative and not in a limiting sense.

We claim:

1. A low profile microswitch particularly useful for keyboards of the kind having an electrically conductive movable contact spherical cap member able to invert its sense of curvature with the application of pressure thereon, characterized in that a first generally annular contact is disposed on a generally planar surface on an insulating substrate arranged for contacting the peripheral area of said cap member; at least three protuberances are formed in the substrate extending above said generally planar surface spaced about each microswitch and adjacent thereto to laterally center the cap member in registry with the annular contact; and a second contact is disposed as a button substantially at the center of said first contact and in such a way so as to be electrically isolated from the first contact.

2. A microswitch according to claim 1, characterized in the substrate is deformed so as to obtain a lowered channel passing under the external periphery of said cap member for realizing an air vent and a passage for conducting traces.

3. A microswitch according to claim 1 characterized in that said contacts are realized by means of the techniques utilized for printed circuits.

4. A microswitch according to claim 1 characterized in that said substrate is constituted by a panel of fibers bonded with a resin.

5. A low profile keyboard comprising an electrically insulative substrate having generally flat top and bottom planar surfaces, a plurality of microswitches formed on the board each comprising a first conductive contact surface disposed on the flat top planar surface, a plurality of spherical cap centering portions spaced about the periphery of a selected circular configuration on the substrate aligned with the first contact surface, the portions each formed of a protuberance extending from the top surface of the substrate and an aligned depression in the bottom surface of the substrate, a second conductive contact surface disposed on the flat top planar surface within the said periphery but electrically separated from the first conductive contact surface and an electrically conductive spherical cap able to invert its sense of curvature with the application of pressure thereon received on each first conductive contact surface centered thereon by the cap centering portions and adapted to make electrical bridging contact between the first and second conductive contact when its curvature is inverted upon application of pressure thereon.

6. A low profile keyboard according to claim 5 in which four spherical cap centering portions are provided for each microswitch.

7. A low profile keyboard according to claim 5 in which a depression is formed in the top planar surface at each microswitch which extends from within the said periphery to a point on the substrate outside the said periphery, the depression extending to a selected depth from the top planar surface, and the second conductive surface is disposed within the depression intermediate the selected depth and the top planar surface and the bottom planar surface, aligned with the depression in the top planar surface, is formed with a surface configuration opposite to that of the depression.

* * * * *